US007575121B2

(12) United States Patent
Ooka et al.

(10) Patent No.: US 7,575,121 B2
(45) Date of Patent: Aug. 18, 2009

(54) PLASTIC CAP FEATURING EXCELLENT SEALING AND VENTING

(75) Inventors: Shinji Ooka, Hiratsuka (JP); Yuji Tomitaka, Hiratsuka (JP); Manabu Aihara, Hiratsuka (JP); Shinya Matsumoto, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 474 days.

(21) Appl. No.: 11/300,401

(22) Filed: Dec. 15, 2005

(65) Prior Publication Data

US 2006/0138073 A1 Jun. 29, 2006

(30) Foreign Application Priority Data

Dec. 16, 2004 (JP) ..... 2004-364348

(51) Int. Cl.
*B65D 53/06* (2006.01)

(52) U.S. Cl. ..... 215/344

(58) Field of Classification Search ..... 215/344, 215/343, 341, 353, 316; 220/229, 265, 203.02, 220/203.01, 240, 806, 804, 803, 802, 801; *B65D 41/02*
See application file for complete search history.

(56) References Cited

U.S. PATENT DOCUMENTS 3,055,526 A * 9/1962 Plunkett ..... 215/329
3,343,700 A * 9/1967 Heubl ..... 215/320
3,411,649 A * 11/1968 Mumford ..... 215/348
3,441,161 A * 4/1969 Van Baarn ..... 215/235
3,494,496 A * 2/1970 Livingstone ..... 215/320
3,568,871 A * 3/1971 Livingstone ..... 215/344
3,625,226 A * 12/1971 Flesselles ..... 131/361
3,707,240 A * 12/1972 Wilson ..... 215/256
3,815,771 A * 6/1974 Marks ..... 215/344
3,844,439 A * 10/1974 Demers et al. ..... 215/344
3,901,404 A * 8/1975 Feldman ..... 215/256
3,991,895 A * 11/1976 Thornton ..... 215/211
4,165,009 A * 8/1979 Murayama ..... 215/230
4,322,012 A * 3/1982 Conti ..... 215/344
4,331,249 A * 5/1982 Banich, Sr. ..... 215/343
4,442,947 A * 4/1984 Banich, Sr. ..... 215/344
4,489,845 A * 12/1984 Aichinger et al. ..... 215/329
4,560,077 A * 12/1985 Dutt ..... 215/307

(Continued)

FOREIGN PATENT DOCUMENTS

CH 607702 A * 10/1978

(Continued)

*Primary Examiner*—Anthony D Stashick
*Assistant Examiner*—Robert J Hicks
(74) *Attorney, Agent, or Firm*—Sughrue Mion, PLLC

(57) ABSTRACT

A plastic cap comprising a top panel and a skirt hanging down from the peripheral edge of the top panel, the inner surface of the top panel forming an inner ring that forms a seal upon coming into intimate contact with the inner surface of the wall of the mouth of a container, and the inner surface of skirt forming a screw thread that comes into engagement with a screw thread formed on the outer surface of the wall of the mouth of the container, wherein a slender recessed portion is formed in a number of at least one in the inner surface of said inner ring extending upward from an end thereof. The cap features both excellent sealing and excellent venting.

11 Claims, 9 Drawing Sheets

U.S. PATENT DOCUMENTS

| | | | | | |
|---|---|---|---|---|---|
| 5,275,287 | A | * | 1/1994 | Thompson | 215/344 |
| 5,348,183 | A | * | 9/1994 | Luch et al. | 220/265 |
| 6,021,912 | A | * | 2/2000 | Hertrampf | 215/344 |
| 6,283,318 | B1 | | 9/2001 | Lee | |
| 6,679,395 | B1 | * | 1/2004 | Pfefferkorn et al. | 215/307 |
| 2001/0027957 | A1 | * | 10/2001 | Kano | 215/341 |
| 2002/0000420 | A1 | * | 1/2002 | Taha | 215/252 |
| 2003/0015490 | A1 | * | 1/2003 | Taha | 215/252 |
| 2004/0060893 | A1 | | 4/2004 | Kano et al. | |
| 2006/0151423 | A1 | * | 7/2006 | Seidita | 215/341 |

FOREIGN PATENT DOCUMENTS

| | | | | |
|---|---|---|---|---|
| CH | 694 019 | A5 | | 6/2004 |
| DE | 199 52 214 | A1 | | 5/2001 |
| EP | 575987 | A2 | * | 12/1993 |
| EP | 0 661 218 | A1 | | 7/1995 |
| EP | 1 481 908 | A1 | | 12/2004 |
| JP | 06122462 | A | * | 5/1994 |
| JP | 2003175948 | A | * | 6/2003 |
| JP | 2004224371 | A | * | 8/2004 |
| WO | 00/56615 | A1 | | 9/2000 |

* cited by examiner

PLASTIC CAP FEATURING EXCELLENT SEALING AND VENTING

BACKGROUND OF THE INVENTION

1. Field of the Invention

The present invention relates to a plastic cap of the type of screw engagement. More specifically, the invention relates to a plastic cap of the type of screw engagement in which an inner ring is formed on the inner surface of the top panel of the cap for forming a seal upon coming in intimate contact with the inner surface of the mouth-wall of the container to accomplish a favorable sealing relying upon the inner ring while providing venting in case the pressure in the bottle is elevated.

2. Description of the Related Art

Plastic caps of the type of screw fitted to the mouth-wall of the container relying on the screw engagement have been widely used, for example, for beverage containers. Usually, an inner ring is formed on the inner surface of the top panel of the cap, and an upper end portion of the mouth-wall of the container enters into between a skirt of the cap and the inner ring in a state where the cap is closed, whereby the inner ring comes into intimate contact with the inner surface of the mouth-wall of the container thereby to form a seal.

The cap of the above structure features a high degree of sealing owing to the inner ring leaving, however, a problem to some extent concerning the venting. That is, when the cap is used for the bottles containing fruit juices, it may happen that the cap pops up from the bottle-mouth due to an increase in the pressure in the bottle that results from fruit juices undergoing the secondary fermentation and producing a carbonic acid gas (this often occurs when a bottle containing fruit juices that is left without all consumed is sealed with the cap again and is left to stand for extended periods of time).

A cap which is free from the above problem and offers an improved gas venting has been proposed in, for example, JP-A-2004-224371 having a coupling portion (reinforcing rib) formed from the inner surface of the inner ring through up to the inner surface of the top panel of the cap.

SUMMARY OF THE INVENTION

The cap proposed in the above JP-A-2004-224371 is such that when the top panel of the cap is domed due to an increase in the pressure in the container, the end of the inner ring deforms inward being pulled by the coupling portion, the intimate adhesion is lost between the outer surface of the inner ring and the inner surface of the mouth-wall of the container, and the gas is easily vented.

This cap, however, involves a problem in that the thickness of the inner ring must be decreased so that the inner ring can be easily deformed by being pulled by the coupling portion when the top panel of the cap is domed. That is, the inner ring that is thickly formed possesses a high rigidity and is not easily deformed even when it is pulled by the coupling portion, making it difficult to vent the gas. On the other hand, the inner ring that is thinly formed offers an increased degree of flexibility but causes a decrease in the sealing of the inner ring.

As described above, the conventional caps are not capable of accomplishing both the sealing and the venting of the caps.

It is therefore an object of the present invention to provide a plastic cap featuring both excellent sealing and venting.

According to the present invention, there is provided a plastic cap comprising a top panel and a skirt hanging down from a peripheral edge of the top panel, an inner surface of said top panel having an inner ring that forms a seal upon coming into intimate contact with an inner surface of a mouth-wall of a container, and an inner surface of said skirt having a screw thread that comes into screw engagement with an outer surface of the mouth-wall of the container, wherein at least one slender recessed portion is formed in an inner surface of said inner ring so as to extend upward from an end thereof.

In the present invention, it is desired that:

(1) The inner ring has a shape which as a whole is inclined to expand outward as it goes downward and is forming an end portion of a decreased thickness, and a seal point P is formed on the outer surface of the inner ring, the seal point P being an inflecting portion where the surface inclined outward as it goes downward is shifted to be inclined inward as it goes downward;

(2) The recessed portion extends upward from an end of the inner surface of the inner ring to be higher than the height of the seal point P;

(3) The recessed portion is formed at one place;

(4) An outer ring is formed on the inner surface of the top panel being positioned on the outer side of the inner ring, the outer ring being so formed that the inner surface thereof comes into intimate contact with the outer surface of the mouth-wall of the container;

(5) An intimate-contact point Q is formed on the inner surface of the outer ring, the intimate-contact point Q being an inflecting portion where the surface inclined inward as it goes downward is shifted to be inclined outward as it goes downward, and the outer ring coming into intimate contact with the outer surface of the wall of the mouth of the container at least at the intimate-contact point Q.

(6) The outer ring has at least one notch formed in a portion which includes the intimate-contact point Q;

(7) The upper end of the recessed portion is positioned over the seal point P by 0.1 to 1.8 mm;

(8) An auxiliary protuberance is formed on the inner surface of the top panel at a portion between the inner ring and the outer ring to form an auxiliary seal upon coming into intimate contact with a corner portion continuing from the top surface of the mouth-wall of the container to the outer surface thereof;

(9) A small protuberance is formed on the inner surface of the top panel at a portion between the inner ring and the auxiliary protuberance; and

(10) The inner ring has a maximum thickness t in a range of 0.5 to 1.5 mm in a horizontal direction at a portion where the recessed portion is formed, and the recessed portion has a width w of 0.5 to 6 mm.

According to the present invention, the inner ring is easily deformed upon doming since a slender recessed portion is formed in the inner surface of the inner ring. That is, when the pressure in the container has increased causing the top panel of the cap to be domed (swollen outward), the inner ring is so deformed that an end thereof is directed to the inside. Here, with the recessed portion being formed as described above, distortion such as wrinkles caused by the deformation are absorbed by the recessed portion. As a result, deformation of the inner ring is promoted, the intimate contact decreases between the outer surface of the inner ring and the inner surface of the mouth-wall of the container, and the gas is easily vented. Besides, in the present invention, there is no need of decreasing the thickness of the inner ring; i.e., the inner ring can be deformed upon doming even when the inner ring has a thickness large enough for maintaining a high degree of sealing like that of the conventional caps. Thus, the present invention accomplishes both excellent sealing and excellent venting.

DETAILED DESCRIPTION OF THE INVENTION

Figure 1:
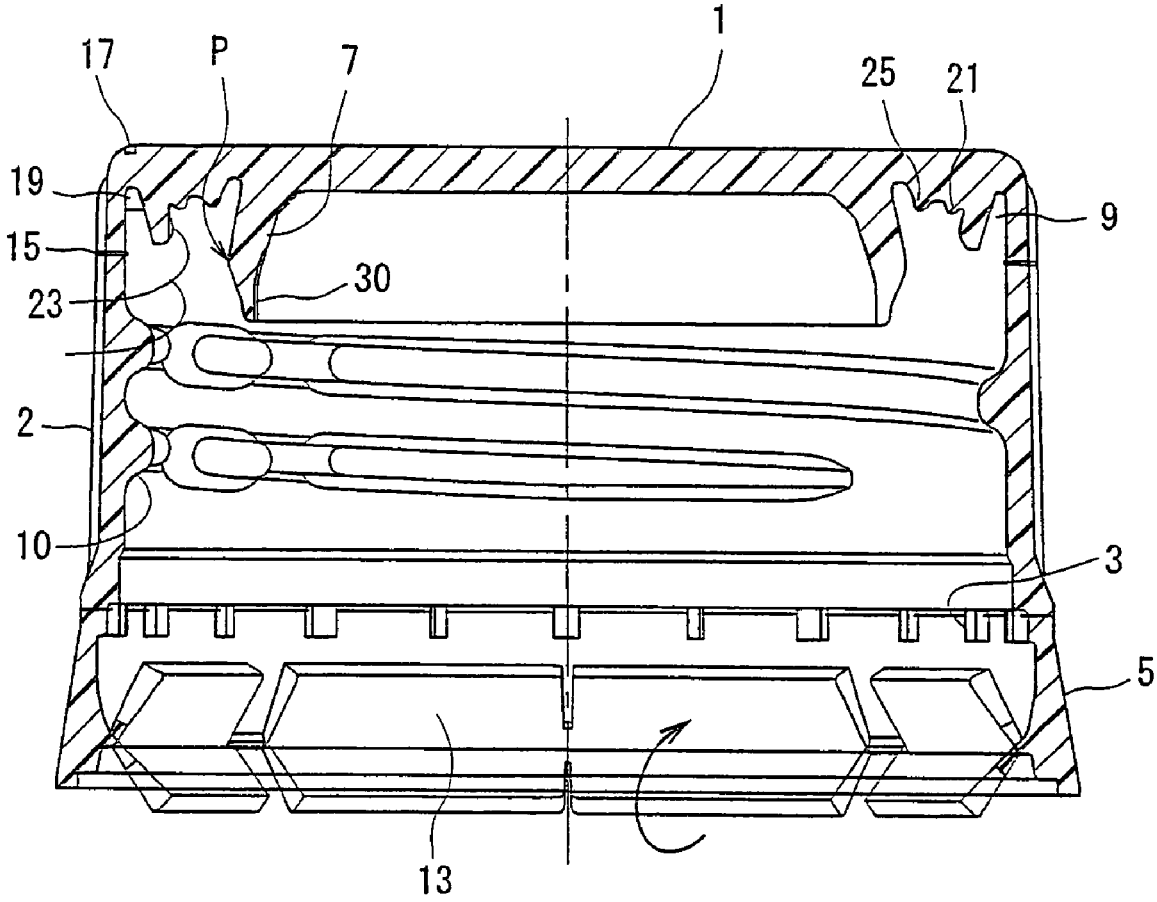
FIG. 1 is a side sectional view of a cap of the present invention.

The present invention will now be described in detail with reference to the accompanying drawings.

Referring to FIGS. 1 to 4, the cap roughly comprises a top panel 1 and a skirt 2 hanging down from the peripheral edge of the top panel 1, and is provided, at the lower end of the skirt 2, with a tamper-evidence band (TE band) 5 via a bridge 3 that can be broken.

An inner ring 7 is formed on the inner surface of the top panel 1 so as to extend downward maintaining a distance from the skirt 2. It is desired to provide an outer ring 9 on the outer side of the inner ring 7, the outer ring 9 having a height lower than the inner ring 7.

A screw thread 10 is formed on the inner surface of the skirt 2 so as to come into engagement with a screw thread 51 formed on the outer surface of the wall 50 of the mouth of the container. That is, the skirt 2 is turned (wrapped and tightened) in a closing direction and the screw thread 10 is brought into screw engagement with the screw thread 51 on the outer surface of the mouth-wall 50 of the container to mount the cap on the mouth-wall 50.

Figure 4:
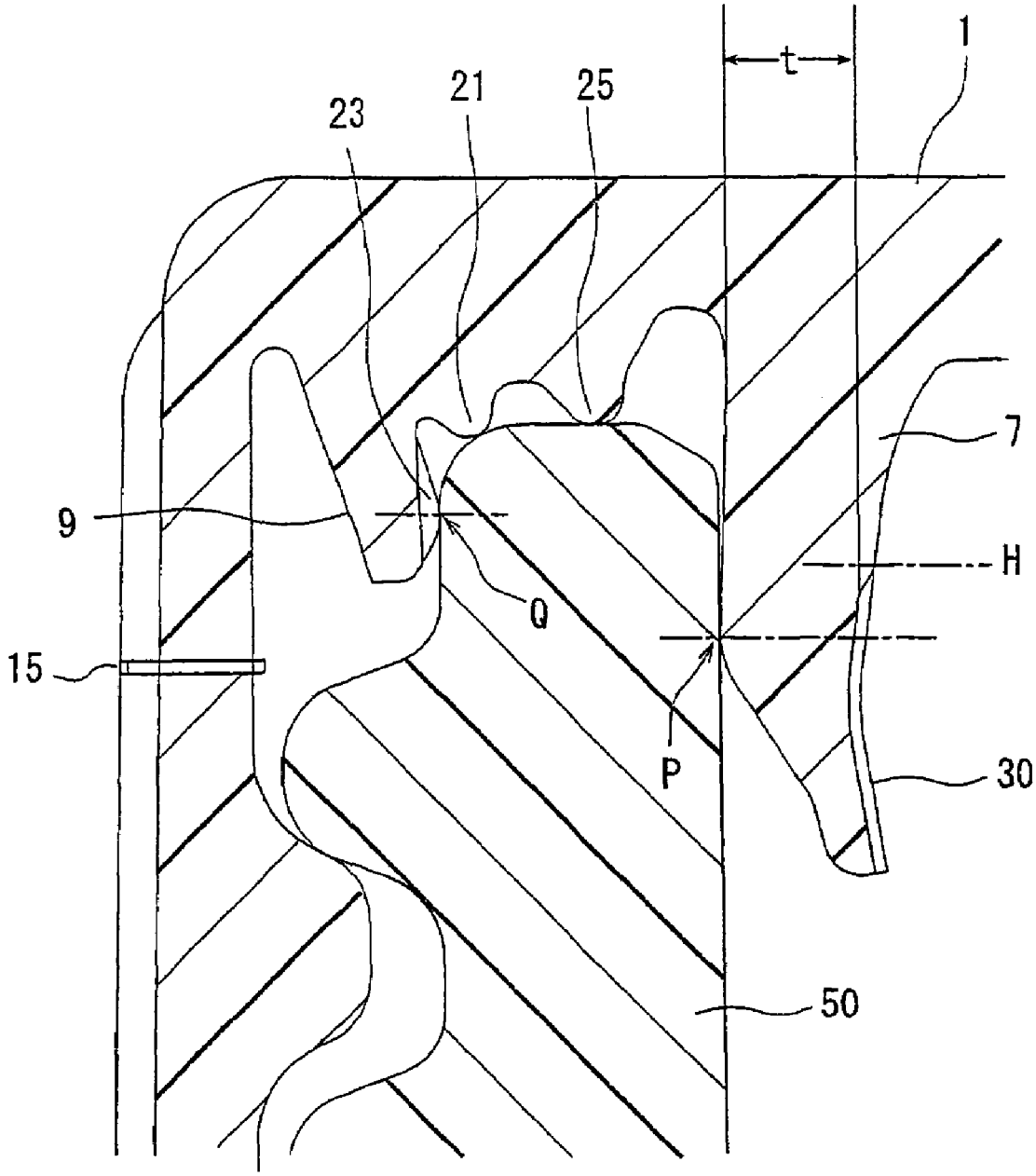
FIG. 4 is a view illustrating a major portion of the cap shown in FIG. 1 on an enlarged scale.

In a state where the cap is mounted on the mouth-wall 50, the outer surface of the inner ring 7 comes into intimate contact with the inner peripheral surface of the mouth-wall 50 thereby to maintain good sealing. For this purpose, as shown in FIGS. 1 and 4, the inner ring 7 has a shape which as a whole is inclined to expand outward as it goes downward and is forming an end portion of a decreased thickness. Therefore, when the cap is mounted on the mouth-wall 50 of the container and the upper portion of the mouth-wall 50 is fitted into space between the inner ring 7 and the skirt 2, the inner ring 7 easily deflects inward, and the outer surface of the inner ring 7 comes into intimate contact with the inner peripheral surface of the mouth-wall 50 to maintain good sealing. That is, a seal point P is formed on the outer surface of the Inner ring 7, and the outer surface of the inner ring 7 reliably comes into intimate contact with the inner peripheral surface of the mouth-wall 50 at the portion of the seal point P. As will be understood from FIG. 1, the seal point P is an inflecting portion where the surface inclined outward as it goes downward is shifted to be inclined inward as it goes downward.

Figure 2:
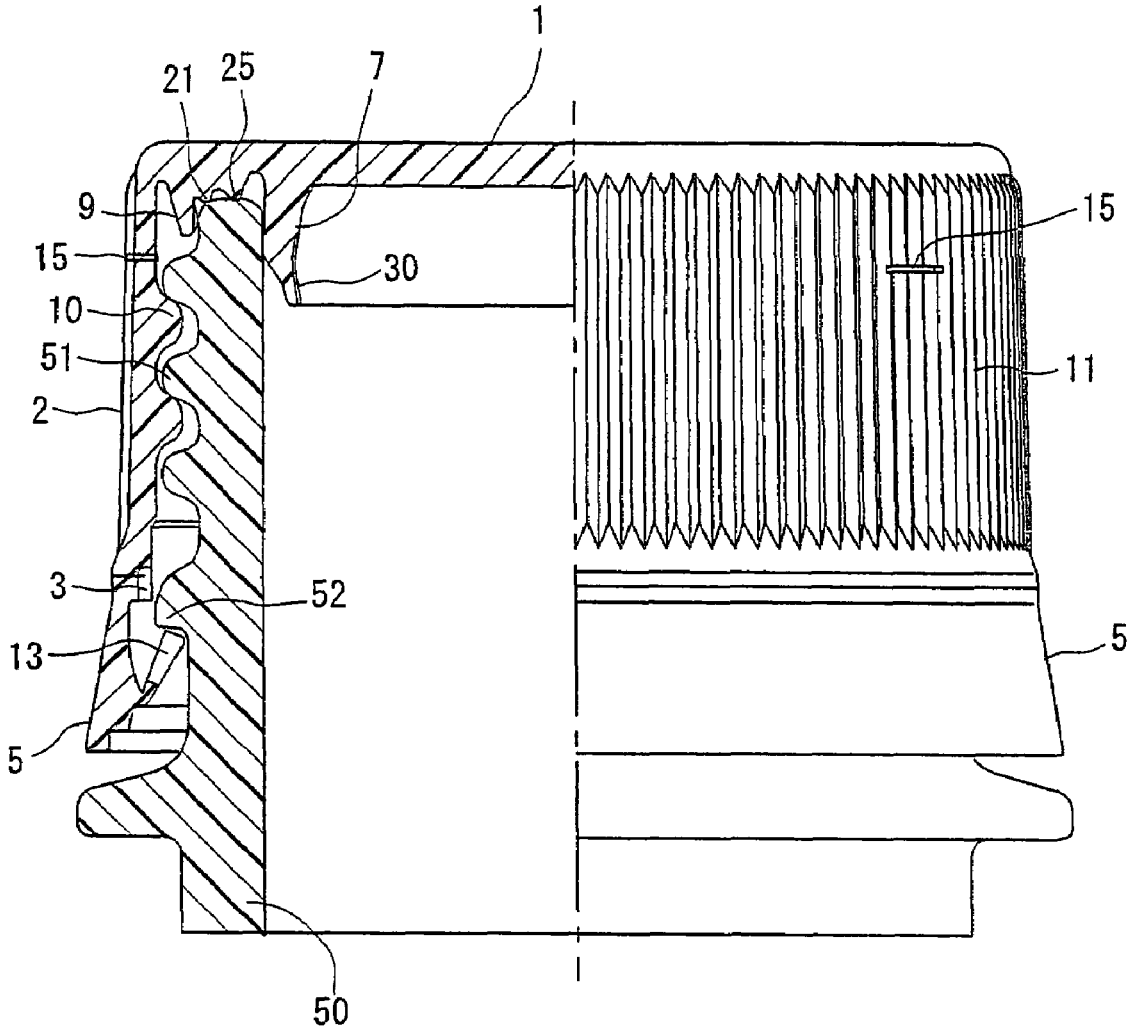
FIG. 2 is a half sectional side view of the cap shown in FIG. 1 in a state where it is mounted on the mouth of a container.

The outer surface of the skirt 2 is knurled as designated at 11 for preventing the slipping, so that the cap can be smoothly turned in the closing direction and in the opening direction (see FIG. 2).

Flap pieces 13 which have been known per se. are provided on the inner surfaces of the TE band 5 so as to come into engagement with a flange portion 52 of the mouth-wall 50 of the container. That is, when the cap that is wrapped and tightened on the mouth-wall 50 is opened, the flap pieces 13 come in contact with the flange portion 52, and the TE band 5 is limited from ascending. The skirt 2, on the other hand, rotates in the opening direction and ascends. Therefore, a bridge 3 linking the lower end of the skirt 2 to the TE band 5 is broken before the sealing portion (portion where the inner ring 7 is brought into intimate contact with the mouth-wall 50, or the seal point P that will be described later) is liberated, and the TE band 5 is removed from the cap. The TE band 5 that is removed from the cap proves the fact that the cap was once opened or the sealing portion was broken.

Referring to FIG. 1, slits 15 are formed in an upper part of the skirt 2 maintaining a suitable distance, enabling the gap between the cap and the mouth-wall 50 of the container to be washed.

Referring to FIGS. 1 and 2, further, a recessed mark 17 for detection is provided at the peripheral edge of the top panel 1 for indicating the closed state of the cap, and a rib 19 is provided being corresponded to the mark 17 and is continuing from the inner surface of the top panel 1 to the upper end on the inner surface of the skirt 2. That is, a state where the cap is wrapped and tightened on the mouth-wall 50 can be confirmed in the step of production relying upon the position of the mark 17. Further, formation of the rib 19 permits the resin to smoothly flow at the time of forming the cap making it possible to avoid defective formation.

Referring to FIG. 4, the outer ring 9 is formed on the outer side of the inner ring 7 such that the inner surface thereof comes into intimate contact with the outer surface of the mouth-wall 50. That is, an intimate-contact point Q is formed on the inner surface of the outer ring 9, the intimate-contact point Q being an inflecting point where the surface inclined inward as it goes downward is shifted to be inclined outward as it goes downward, and the inner surface of the outer ring 9 comes into intimate contact with the outer surface of the mouth-wall 50 at the intimate-contact point Q. The outer ring 9 suppresses the play of when the cap is opened, and enhances the tamper evidence (TE). When, for example, the cap (skirt 2) is turned in the opening direction so as to be opened, the inner ring 7 can be turned in concentric with the inner peripheral surface of the mouth-wall 50 without play owing to the outer ring 9, and the angle of rotation can be widened until the seal is broken while stably maintaining the sealing relying upon the inner ring 7 and effectively avoiding the breakage of sealing before the bridge 3 is broken.

Further, the outer ring 9 is provided with a plurality of notches 23 for venting in the inner peripheral surface thereof that comes into intimate contact with the outer surface of at least the wall 50 of the mouth of the container. This function will be described later.

In the above cap, it is desired that an auxiliary protuberance 21 is formed on the inner surface of the top panel 1 at a portion between the outer ring 9 and the inner ring 7 and, particularly, at a portion close to the root of the outer ring 9. As shown in FIGS. 2 and 4, the auxiliary protuberance 21 comes into intimate contact with the corner portion of from the top surface of the mouth-wall 50 to the outer surface thereof, and reinforces the sealing which is accomplished by the inner ring 7. That is, a drop in the sealing can be effectively avoided by the provision of the auxiliary protuberance 21 in addition to the provision of the inner ring 7 even when there is formed fine ruggedness on the mouth-wall 50 due to the contraction at the time of forming the container.

It is further desired to form a small protuberance 25 on the inner surface of the top panel 1 at a portion between the inner ring 7 and the outer ring 9. The small protuberance 25 has a function for preventing the over-tightening at the time of capping and for increasing the shock resistance. For example, shock that is exerted in the axial direction of the cap when it is dropped is relaxed by the small protuberance 25 that is in contact with the top surface of the mouth-wall 50, preventing the breakage of seal that is maintained by the intimate contact of the inner ring 7 with the inner surface of the mouth-wall 50, and by the intimate contact of the auxiliary protuberance 21 with the corner portion of the mouth-wall 50. In the embodiment shown in FIG. 4, the small protuberance 25 is in contact with the top surface of the mouth-wall 50 in a state where the cap is being mounted on the mouth-wall 50. The small protuberance 25, however, may be separated away from the top surface of the mouth-wall 50. That is, the shock can be relaxed and the breakage of seal is prevented even when the small protuberance 25 is brought into contact with the top surface of the mouth-wall 50 upon the application of an external force. The small protuberance 25 may be circularly formed or may be intermittently formed. In particular, the sealing can be enhanced by circularly forming the small protuberance 25 and by causing an end thereof to come into intimate contact with the top surface of the mouth-wall 50.

Figure 5:
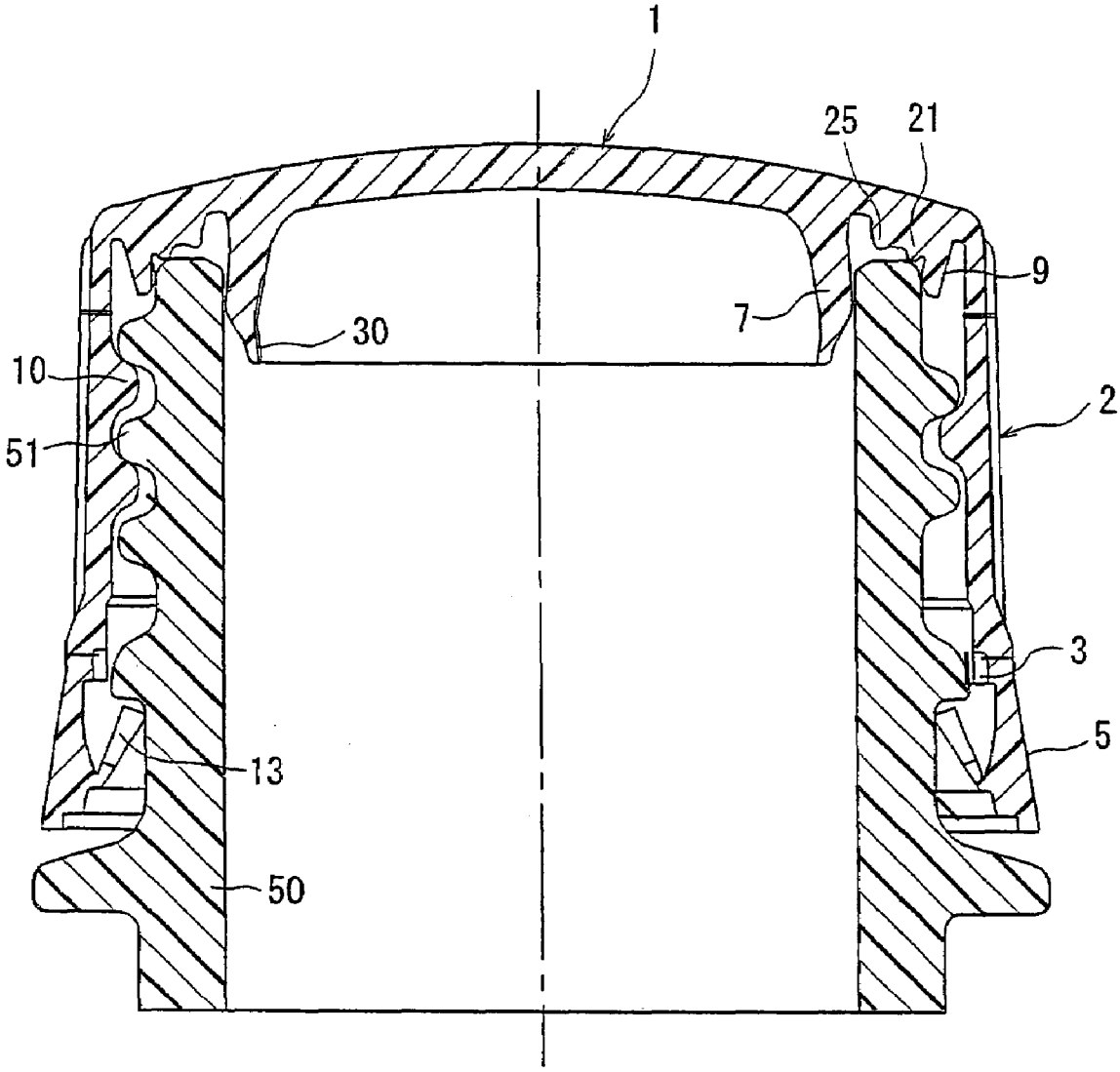
FIG. 5 is a view illustrating a state where the top panel of the cap shown in FIG. 1 is domed due to an increase in the pressure in the container.
Figure 6:
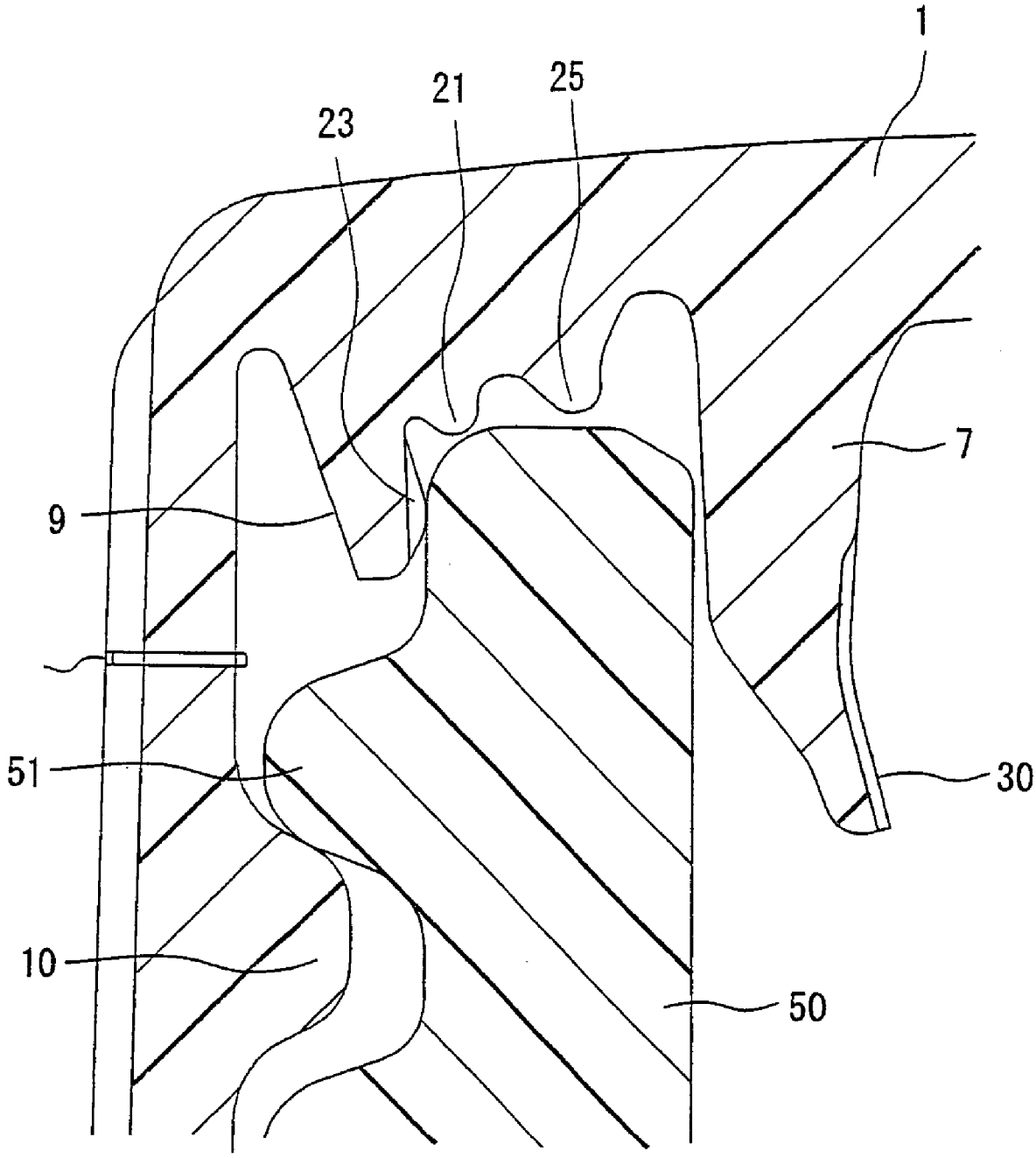
FIG. 6 is a view illustrating a major portion of the cap in the state of FIG. 5 on an enlarged scale.

In the present invention, it is important that a slender recessed portion 30 is formed in the inner surface of the inner ring 7 so as to extend upward from an end thereof. That is, referring to FIG. 4 as well as FIGS. 5 and 6 illustrating a state where a doming is taking place due to an increase in the pressure in the container, when the top panel 1 of the cap swells outward, the inner ring 7 is easily so deformed (i.e., so inclined) that an end thereof is directed to the inside. The portion having the recessed portion 30 formed therein tends to be easily deformed, and deformation of the inner ring 7 is promoted starting from the above portion. Due to the deformation of the inner ring 7, the outer surface (particularly, seal point P) of the inner ring 7 separates away from the inner surface of the mouth-wall 50 and, at the same time, a gap is formed between the mouth-wall 50 and the protuberance 25 or the auxiliary protuberance 21 that is formed near the root of the outer ring 9. Besides, notches 23 have been formed in the outer ring 9. According to the present invention, therefore, the gas is smoothly vented when the doming takes place to a large degree due to an increase in the pressure in the container in excess of a predetermined value, effectively preventing the popping up of the cap or the breakage of the container caused by a large increase in the pressure in the container. The notches 23 are formed in a plural number (e.g., three). Among them, at least one notch 23 is desirably located near the recessed portion 30. Further, the notch 23 has a width of about 3 mm in the circumferential direction and a depth (at the intimate-contact point Q) of about 0.1 mm.

Further, the greatest advantage of the present invention is that as a result of forming the recessed portion 30 in the inner surface of the inner ring 7, the inner ring 7 can be easily deformed when the doming occurs despite the inner ring 7 possesses a thickness which is large enough to maintain good sealing. That is, the inner ring 7 accomplishes excellent sealing as well as excellent venting.

Referring to FIG. 4, it is desired that the recessed portion 30 formed in the inner surface of the inner ring 7 extends upward to be higher than the seal point P formed on the outer surface of the inner ring 7. That is, if the height H of the upper end of the recessed portion 30 is lower than the seal point P, the seal point P is not sufficiently separated away from the inner surface of the mouth-wall 50, which results in a decrease in the venting.

Figure 7:
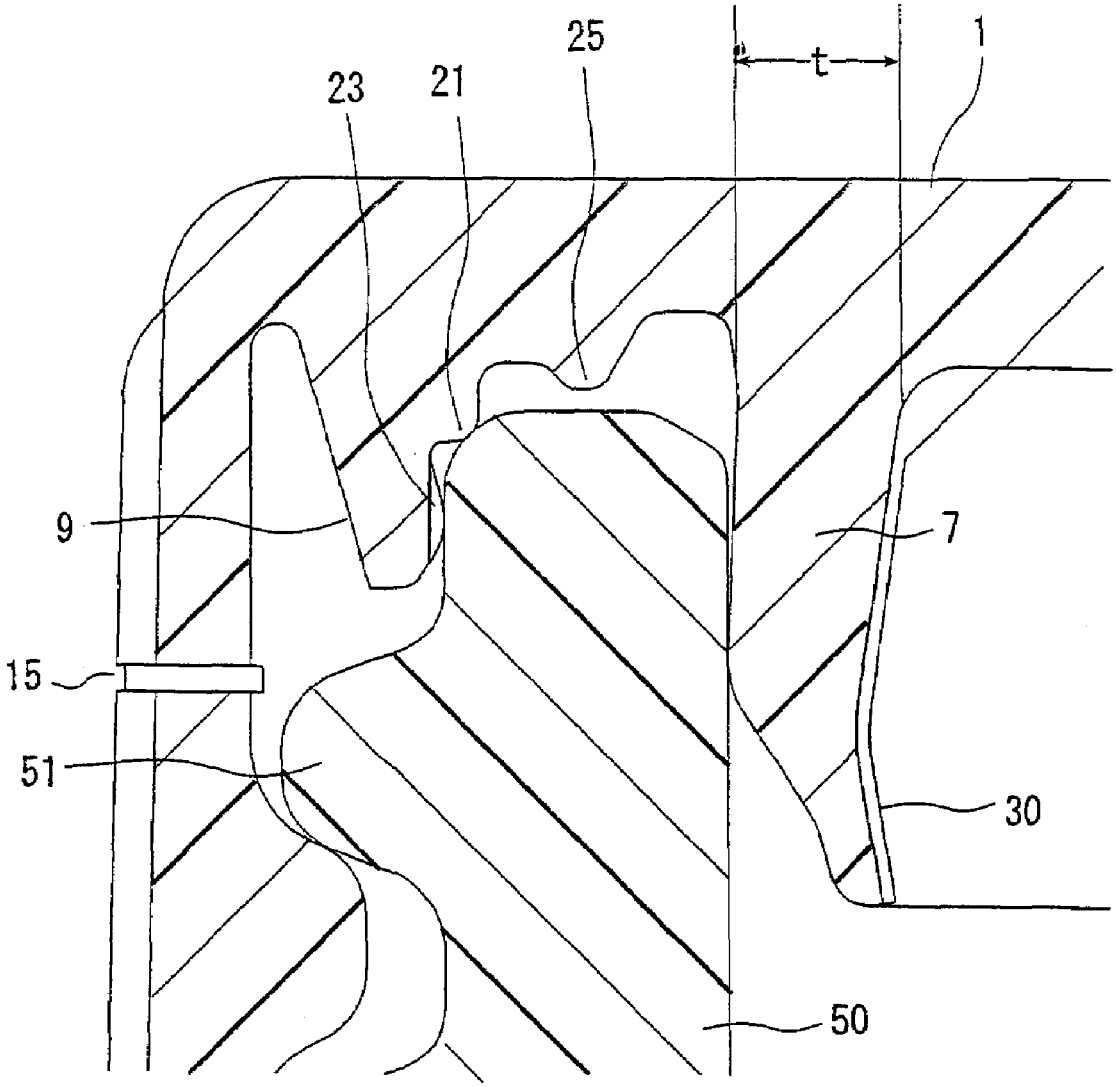
FIG. 7 is a view illustrating a major portion of the cap according to another embodiment of the present invention on an enlarged scale.

In the above embodiment, further, the recessed portion 30 is extending on the way of the inner ring 7 from the end of the inner ring 7. As shown in FIG. 7 which is a view of a major portion on an enlarged scale, however, the recessed portion 30 can be formed, for example, all the way from the end to the root of the inner ring 7 In this case, the inner ring 7 can be deformed to a maximum degree when the doming takes place, and a maximum degree of venting is accomplished.

As the recessed portion 30 extends upward from the end of the inner ring 7, however, the inner ring 7 tends to be highly deformed causing a decrease in the tamper evidence. That is, when the inner ring 7 is easily deformed, the seal is subject to be broken with a small angle of rotation when the cap is turned and is removed from the mouth-wall 50; i.e., the seal is broken before the above bridge 3 is broken. Thus, the breakage of seal that takes place before the bridge 3 is broken means that the seal breaks even when the TE band 5 has not been separated away or, in other words, means a decrease in the tamper evidence. In the present invention, therefore, it is desired to so determine the upper end position of the recessed portion 30 as to exhibit excellent venting without spoiling the tamper evidence. As shown, for example, in FIG. 4, therefore, it is desired that the upper end position H of the recessed portion 30 is higher than the seal point P and, particularly, the upper end position H of the recessed portion 30 is over the seal point P of the inner ring 7 by 0.1 to 1.8 mm. When the upper end position H of the recessed portion 30 is lower than the above range, the venting tends to decrease. When the upper end position H of the recessed portion 30 is higher than the above range, on the other hand, the tamper evidence tends to be deteriorated.

Figure 3:
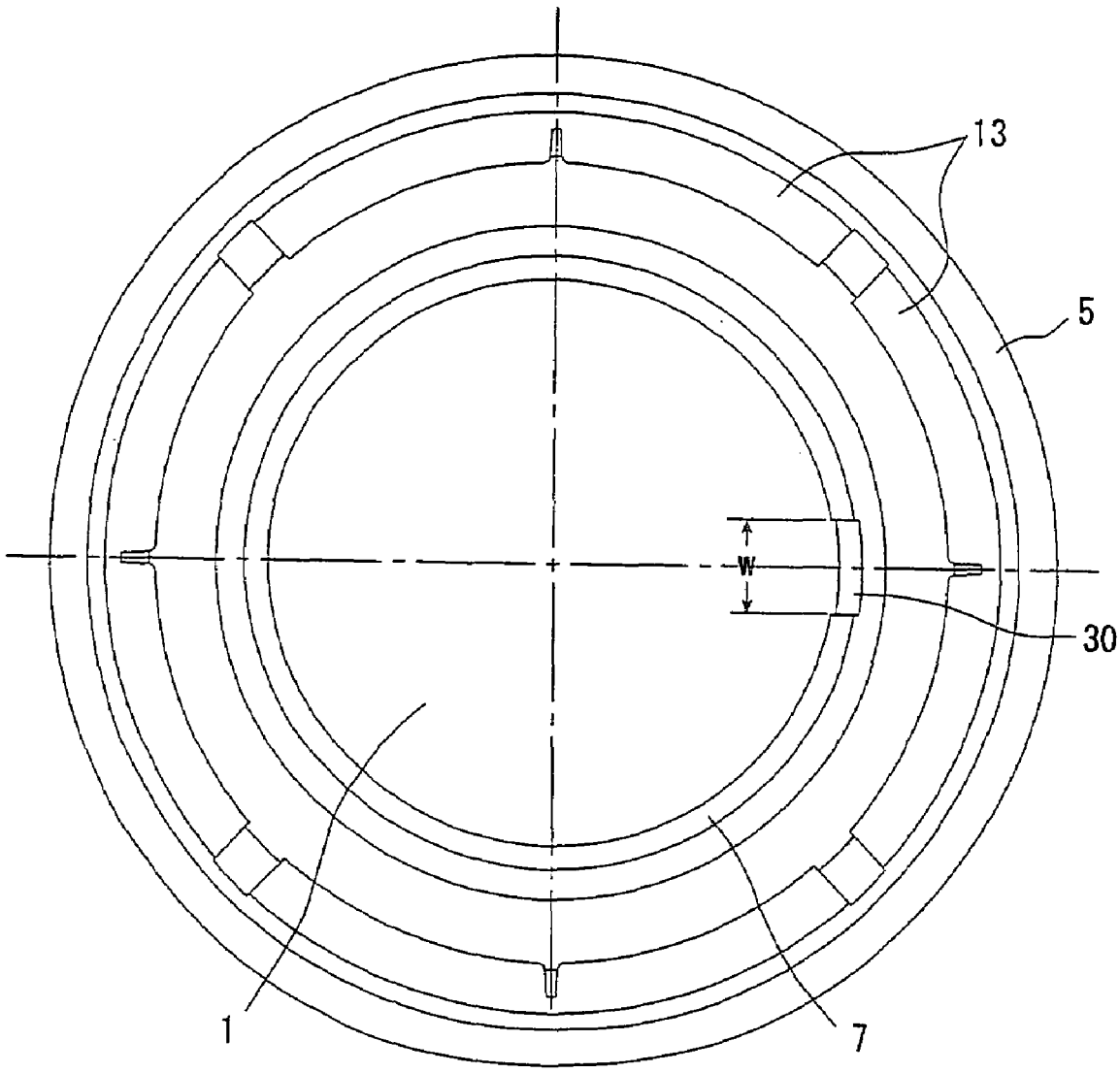
FIG. 3 is a bottom view of the cap shown in FIG. 1.
Figure 8:
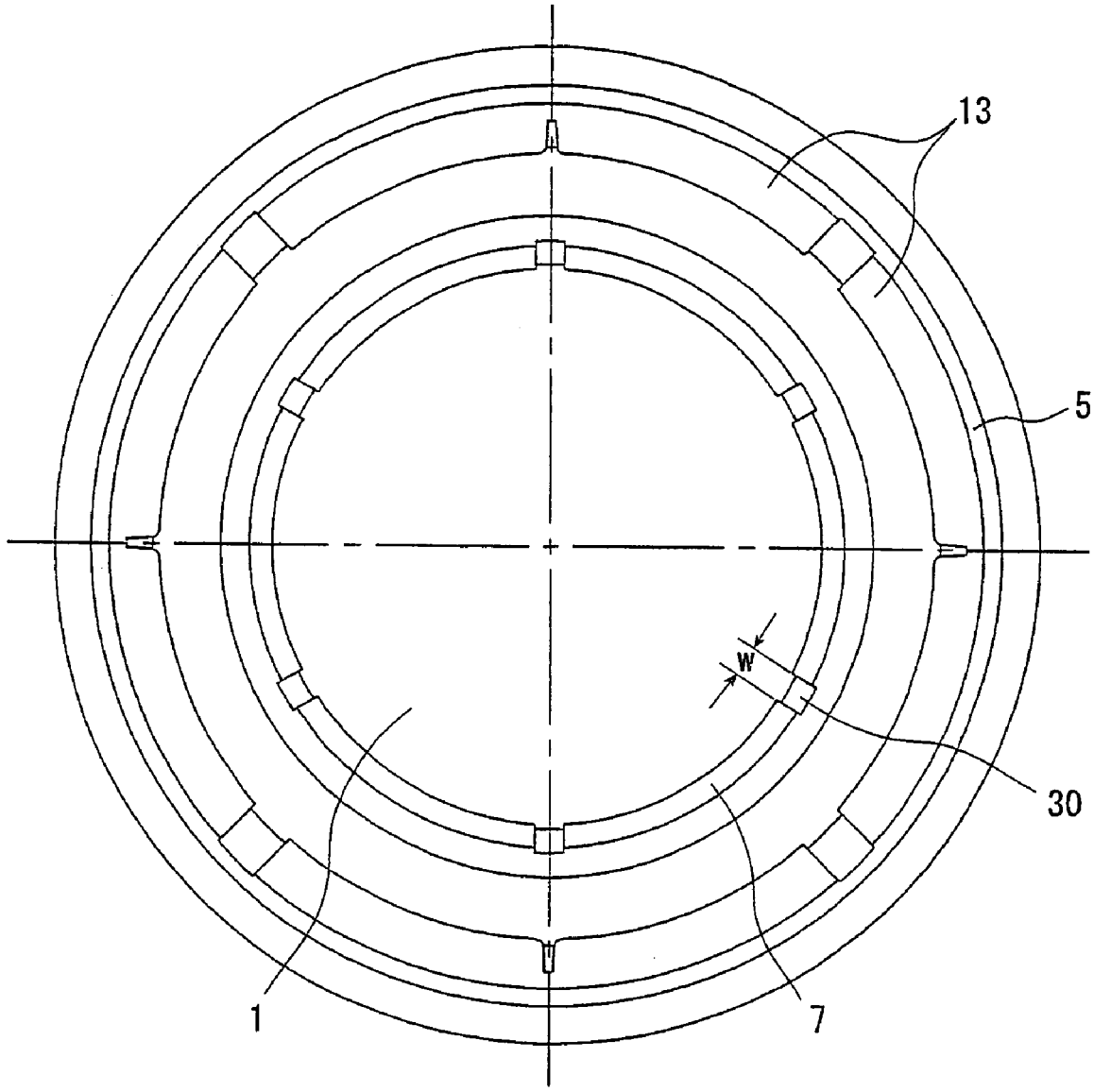
FIG. 8 is a bottom view of the cap of FIG. 7.

The recessed portion 30 may be formed in a number of one or in a plural number. In the cap of FIG. 7 as shown in, for example, in a bottom view of FIG. 8, the recessed portions 30 are formed in a plural number (six). However, increasing the number of the recessed portions 30 may cause the inner ring 7 to be deformed unnecessarily resulting in a decrease in the sealing or in the tamper evidence. As shown in FIG. 3, therefore, it is most desired to form the recessed portion 30 in a number of one. This is because, if the recessed portion 30 has a width to some extent, venting can be maintained to a sufficient degree even when the recessed portion 30 is formed in a number of only one. That is, if the sealing by the seal point P is broken even at one place accompanying an abrupt increase in the pressure of gas in the container, the gas is vented from that place in a concentrated manner. When the recessed portions 30 are formed in a plural number as shown in FIG. 8, the plurality of recessed portions may be symmetrically formed maintaining a predetermined distance or may be formed being collected in part of the regions of the inner surface of the inner ring 7 in the circumferential direction thereof. With the plurality of recessed portions 30 being formed in a collected manner in particular, the inner ring 7 is deformed in a distorted manner when the internal pressure is elevated, causing the intimate contact to be easily broken due to the deformation and enhancing the venting.

In order to maintain good balance between the venting and the sealing by the inner ring according to the present invention, in particular, it is desired that a maximum thickness t (see FIG. 4) of the inner ring 7 in the horizontal direction is in a range of 0.5 to 1.5 mm in a portion where the recessed portion 30 is formed, and the width w (see FIG. 3) of the recessed portion 30 is in a range of 0.5 to 6 mm. When the thickness t is-too great or when the width w is too narrow, the inner ring 7 is not deformed despite the doming is taking place and, hence, the venting is deteriorated. When the thickness t is too small or when the width w is too great, the inner ring 7 tends to be easily deformed causing a decrease in the sealing or in the tamper evidence. Further, though it may vary depending upon the thickness t, upon the number of the recessed portions 30 or upon the width w thereof, the depth of the recessed portion 30 is, usually, in a range of 0.05 to 0.30 mm.

Figure 9:
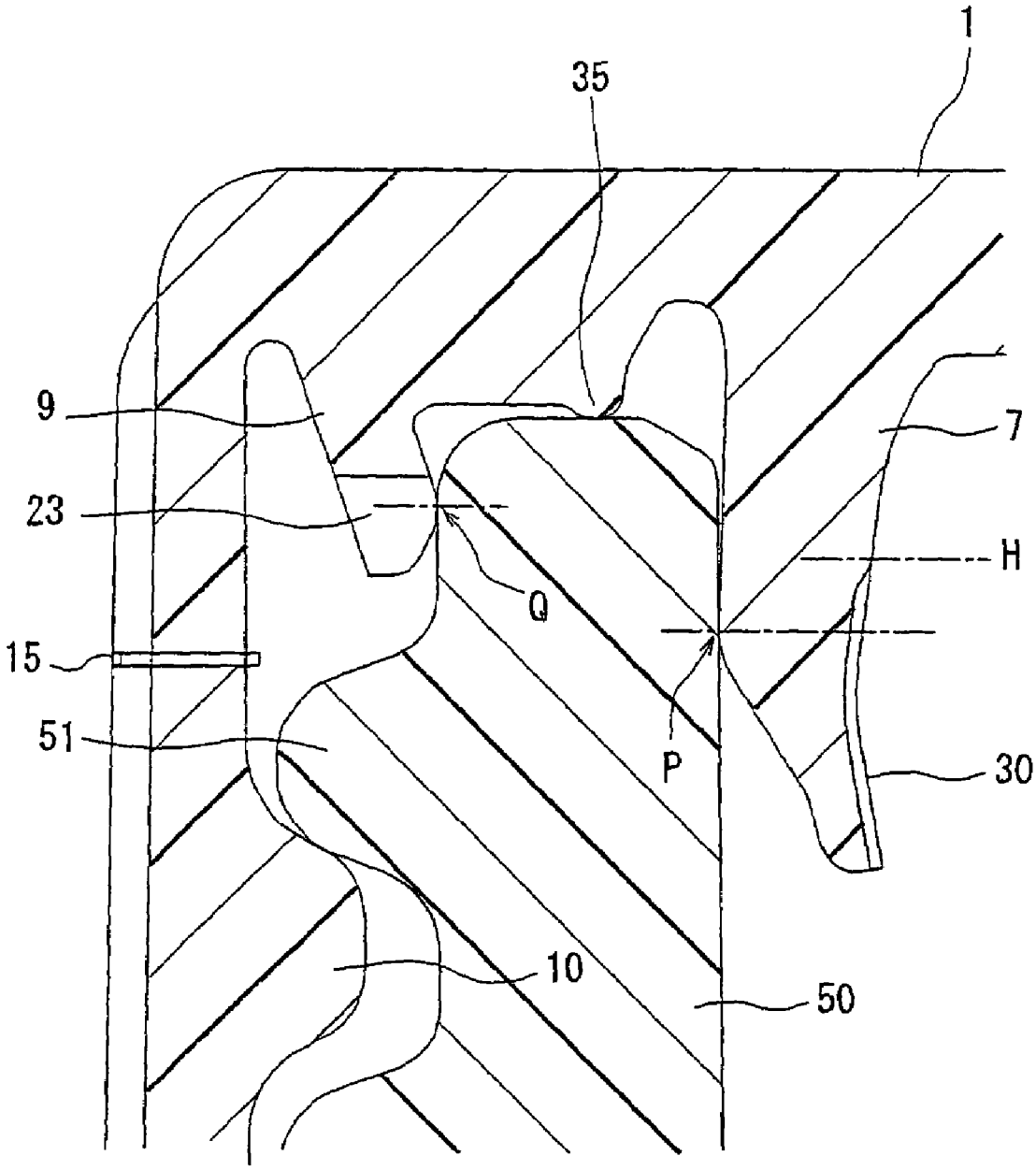
FIG. 9 is a view illustrating the cap according to a further embodiment of the present invention on an enlarged scale.

According to the present invention described above, design can be varied in a variety of ways. As shown in, for example, FIG. 9, there may not be formed the auxiliary protuberance 21 that comes into intimate contact with the corner portion of the wall 50 of the mouth of the container but, instead, there may be formed an auxiliary protuberance 35 that comes into intimate contact with the top surface of the mouth-wall 50. In the embodiments of FIGS. 1 to 8, the notch 23 for venting is formed by cutting the inner surface only of the outer ring 9. As shown in FIG. 9, however, it is also allowable to form the notch 23 for venting by cutting off the whole lower portion of the outer ring 9 but including an intimate-contact point Q. In this case, too, the seal is effectively avoided from being broken by the play of the cap at the time when the cap is opened, the seal is not broken before the bridge 3 is broken, and tamper evidence is favorably maintained. By forming the recessed portion 30 in the inner surface of the inner ring 7, further, the venting is enhanced when the doming takes place.

Further, the cap of the invention can be produced by using various plastic materials such as a low-, intermediate- or high-density polyethylene, a linear low-density polyethylene, a polypropylene, a thermoplastic polyester, a polyamide, a styrene resin or an ABS resin relying upon the integral molding such as injection molding or compression molding.

EXAMPLES

Effects of the invention will now be described by way of the following Experiments. Here, however, the invention is in no way limited to the Experiments only.

Cap A (Present Invention):

There was formed by compression molding a cap having the same shape as that of FIG. 1 and that could be wrapped and tightened to the mouth of the container of a nominal diameter of 28 mm.

One recessed portion 30 (width w of 3 mm) was formed. The distance between the upper end position H of the recessed portion 30 and the seal point P was 0.4 mm. The root portion of the inner ring 7 forming the recessed portion 30 therein possessed a thickness of 1.1 mm, and the recessed portion 30 possessed a depth of 0.1 mm.

Cap B (Present Invention):

A cap B was formed in quite the same manner as the cap A but forming six recessed portions 30 in the inner surface of the inner ring 7 maintaining an equal distance, each recessed portion 30 having a width w of 1 mm, a depth of 0.15 mm and running over the full length from the end of the inner ring 7 up to the root portion thereof.

Cap C (Comparative Example):

A cap C was formed in quite the same manner as the cap A but without forming recessed portion 30 in the inner surface of the inner ring 7.

Experiment 1 (Drop Impact Test):

500-Milliliter PET bottles were filled with a 1% orthotolidine aqueous solution heated at 87° C., wrap-tightened with caps A to C, cooled with the shower, and preserved at normal temperature for 24 hours to prepare test samples on which the caps A to C were wrap-tightened, each in a number of 10.

Hypochlorous acid was dropped on the caps of the test samples each of a number of 10 prepared above. The test samples in an inverted state were dropped in a vertical direction on a steel cylindrical member of which the upper surface had been inclined at 10° from a height of 100 cm. Thereafter, the test samples were immersed in the hypochlorous acid diluted with the tap water of 5° C. for 24 hours.

There was recognized no change in the color of the 1% orthotolidine aqueous solution in the bottles of the test samples each of a number of 10 to which the caps A and B of the invention and the caps C of Comparative Example had been wrap-tightened. That is, the sealing was not broken by the shock and the external air was not sucked into the bottles; i.e., a favorable seal was maintained.

Experiment 2 (Vent Test):

500-Milliliter PET bottles were filled with the tap water heated at 87° C., wrap-tightened with caps A to C, cooled with the shower, and preserved at normal temperature for 24 hours to prepare test samples on which the caps A to C were wrap-tightened, each in a number of 10.

The test samples each of a number of 10 prepared above were held in a water vessel, and a needle having a nitrogen injection hole was stubbed into the top panels of the caps. Nitrogen was injected through the injection hole at a rate of 0.034 MPa/sec to measure the pressure in the bottle at which the seal between the bottle and the cap was broken and nitrogen leaked out. Here, however, the measurement was taken in a state where the test samples were held in a casing such that the bottles were not broken by the pressure of the gas.

In the test samples of the number of 10 wrap-tightened with the cap A of the invention, nitrogen leaked at an average pressure of 0.78 MPa and the gas could be vented. In the test samples of the number of 10 wrap-tightened with the cap B of the invention, nitrogen leaked at an average pressure of 0.56 MPa and the gas could be vented. In the test samples of the number of 10 wrap-tightened with the cap C of Comparative Example, on the other hand, nitrogen did not leak despite the pressure in the bottle was elevated up to 1.2 MPa (i.e., the gas could not be vented).

Experiment 3 (Tamper Evidence Test).

500-Milliliter PET bottles were filled with the water heated at 87° C., wrap-tightened with caps A to C, cooled with the shower, and preserved at normal temperature for 24 hours to prepare test samples on which the caps A to C were wrap-tightened, each in a number of 10.

The above test samples were measured for their leak angles and bridge angles by the methods described below.

Prior to measuring the leak angle and the bridge angle, a straight line was drawn on the caps and on the bottles by using a black Magic Ink (i.e., marked with a marking ink).

Next, the cap was turned in the opening direction at a predetermined low speed to calculate an angle of rotation (leak angle) of the cap of when the level of water started moving in the bottle and an angle of rotation (bridge angle) of the cap of when the bridge coupling the TE band started breaking from a deviation between the straight line drawn on the bottle and the straight line drawn on the cap.

The leak angle represents the angle of rotation of the cap until the seal is broken in opening the cap, and the start of motion of the level of water in the bottle is judged by naked eyes. In calculating the bridge angle, further, the breakage of the bridge was judged relying upon the sound that generated when the bridge was broken.

From the leak angle and bridge angle measured above, the BL angles were found in accordance with the following relationship:

$$BL\ \text{angle}=(\text{leak angle})-(\text{bridge angle})$$

for all of the samples, and the number of the samples having BL angles of a minus sign were found. The BL angle of the minus sign means that the sealing is breaking before the bridge is broken. The larger the number of samples having BL angles of the minus sign, the lower the tamper evidence. The smaller the number of samples having BL angles of the minus sign, on the other hand, the more excellent the tamper evidence.

The BL angles of the minus sign were exhibited by none of the test samples wrap-tightened with the caps A and C each of the numbers of 10. Among 10 testing samples wrap-tightened with the caps B, however, two of them exhibited BL angles of the minus sign.

The results of Experiments 1 to 3 above were as shown in Table 1 below.

TABLE 1

| | Upper end of recessed portion | Recessed portion Width w (mm) | Depth (mm) | Number of recessed portions | TE (ratio of minus BL values) | Average vent value (MPa) | Drop impact |
|---|---|---|---|---|---|---|---|
| A | 0.4 mm over seal point P | 3 | 0.10 | 1 | 0/10 | 0.78 | 0/10 |
| B | up to root of inner ring | 1 | 0.15 | 6 | 2/10 | 0.56 | 0/10 |
| C | none | — | — | — | 0/10 | 1.20 | 0/10 |

The invention claimed is:

1. A plastic cap comprising a top panel and a skirt hanging down from a peripheral edge of the top panel, an inner surface of said top panel having an inner ring that forms a seal upon coming into intimate contact with an inner surface of a mouth-wall of a container, and an inner surface of said skirt having a screw thread that comes into screw engagement with an outer surface of the mouth-wall of the container, wherein at least one slender recessed portion is formed so as to extend inward into an inner surface of said inner ring and so as to extend upward from an end thereof.

2. A plastic cap according to claim 1, wherein said inner ring has a shape which as a whole is inclined to expand outward as it goes downward and is forming an end portion of a decreased thickness, and a seal point P is formed on an outer surface of said inner ring, the seal point P being an inflecting portion where the surface inclined outward as it goes downward is shifted to be inclined inward as it goes downward.

3. A plastic cap according to claim 2, wherein said slender recessed portion extends upward from an end of the inner surface of said inner ring to be higher than at least the height of said seal point P.

4. A plastic cap according to claim 1, wherein said slender recessed portion is formed at one place.

5. A plastic cap according to claim 2, wherein an outer ring is formed on the inner surface of said top panel being positioned on an outer side of the inner ring, said outer ring being so formed that an inner surface thereof comes into intimate contact with the outer surface of the mouth-wall of the container.

6. A plastic cap according to claim 5, wherein an intimate-contact point Q is formed on the inner surface of said outer ring, the intimate-contact point Q being an inflecting portion where the surface inclined inward as it goes downward is shifted to be inclined outward as it goes downward, and said outer ring coming into intimate contact with the outer surface of the mouth-wall of the container at the intimate-contact point Q.

7. A plastic cap according to claim 6, wherein said outer ring has at least one notch formed in a portion which includes said intimate-contact point Q.

8. A plastic cap according to claim 3, wherein an upper end of said slender recessed portion is positioned over said seal point P by 0.1 to 1.8 mm.

9. A plastic cap according to claim 5, wherein an auxiliary protuberance is formed on the inner surface of said top panel at a portion between said inner ring and said outer ring to form an auxiliary seal upon coming into intimate contact with a corner portion continuing from a top surface of the mouth-wall of the container to the outer surface thereof.

10. A plastic cap according to claim 5, wherein a small protuberance is formed on the inner surface of said top panel at a portion between said inner ring and said auxiliary protuberance.

11. A plastic cap according to claim 1, wherein the inner ring has a maximum thickness t in a range of 0.5 to 1.5 mm in a horizontal direction at a portion where said slender recessed portion is formed, and said slender recessed portion has a width w of 0.5 to 6 mm.

* * * * *